US009744504B2

(12) United States Patent
Sandu

(10) Patent No.: US 9,744,504 B2
(45) Date of Patent: Aug. 29, 2017

(54) DOUBLE-CONE PUMPING DEVICE

(71) Applicant: NESTEC S.A., Vevey (CH)

(72) Inventor: Constantine Sandu, Solon, OH (US)

(73) Assignee: Nestec S.A., Vevey (CH)

( * ) Notice: Subject to any disclaimer, the term of this patent is extended or adjusted under 35 U.S.C. 154(b) by 186 days.

(21) Appl. No.: 14/407,149

(22) PCT Filed: Jun. 27, 2013

(86) PCT No.: PCT/EP2013/063478

§ 371 (c)(1),
(2) Date: Dec. 11, 2014

(87) PCT Pub. No.: WO2014/001436

PCT Pub. Date: Jan. 3, 2014

(65) Prior Publication Data

US 2015/0174538 A1 Jun. 25, 2015

Related U.S. Application Data

(60) Provisional application No. 61/666,176, filed on Jun. 29, 2012.

(51) Int. Cl.

| | |
|---|---|
| ***B01F 7/00*** | (2006.01) |
| ***B01F 7/16*** | (2006.01) |
| ***B01F 3/12*** | (2006.01) |
| ***F04D 7/04*** | (2006.01) |

(52) U.S. Cl.

CPC ..... *B01F 7/00541* (2013.01); *B01F 3/1221* (2013.01); *B01F 7/00241* (2013.01); *B01F 7/1625* (2013.01); *F04D 7/045* (2013.01); *B01F 2215/0014* (2013.01)

(58) Field of Classification Search

CPC ..... B01F 15/00006; B01F 7/1625; B01F 7/00541

See application file for complete search history.

(56) References Cited

U.S. PATENT DOCUMENTS

| | | | | |
|---|---|---|---|---|
| 3,252,690 A * | 5/1966 | Martin | B01F 7/00241 | 366/265 |
| 4,720,360 A * | 1/1988 | Melber | B01F 3/04241 | 138/44 |
| 4,938,899 A | 7/1990 | Oros et al. | | |
| 2002/0118597 A1* | 8/2002 | Korstvedt | B01F 7/1625 | 366/265 |

FOREIGN PATENT DOCUMENTS

| | | |
|---|---|---|
| JP | 5567318 | 5/1980 |
| KR | 20090061616 | 6/2009 |

* cited by examiner

*Primary Examiner* — Tony G Soohoo
*Assistant Examiner* — Anshu Bhatia
(74) *Attorney, Agent, or Firm* — K&L Gates LLP

(57) ABSTRACT

The invention relates to a double-cone pumping device, designed to provide for flow of the liquid product only on the outer side of the rotating cones, making it compatible with mixing of particulate-containing liquid products; and specifically advanced for high pumping capacity in mixing-agitation applications in food processing. The double-cone pumping device comprises two cones that are axially symmetrically arranged with their large bases abutting, and rotatable around the axis, and an axial shaft that connects to driving means. The invention also relates to a use of this pump in processing of liquid food.

8 Claims, 2 Drawing Sheets

DOUBLE-CONE PUMPING DEVICE

CROSS REFERENCE TO RELATED APPLICATIONS

The present application is a National Stage of International Application No. PCT/EP2013/063478, filed on Jun. 27, 2013, which claims priority to U.S. Provisional Application Serial No. 61/666,176, filed on Jun. 29, 2012, the entire contents of which are being incorporated herein by reference.

The present invention generally refers to a pumping device. In particular, the invention relates to a double-cone pumping device for food-processing mixing and agitation of liquid products, including particulate-containing liquid products. More particular, the invention relates to double-cone pumping device for mixing and agitation inside processing vessels.

BACKGROUND

It is known in the food processing industry to use mixing-agitation devices built on the concept of rotating hollow cones, where the liquid is accelerated on the outer and inner sides of the hollow cones. However, since a flow of the liquid product on the inner side of the hollow cones is involved, there is a particle-size limitation that restricts the practical application of these mixing-agitation devices. In fact, these types of mixing-agitation devices are mainly utilized for comminution or micronization.

The subject of rotating cones or conical-surfaces is well known in the literature. For instance, Bruin, S., Velocity Distribution in a Liquid Film Flowing over a Rotating Conical Surface, Chemical Engineering Science 24, pp. 1647-1654, 1969. Under the influence of the centrifugal force, the flow along the surface of a rotating cone causes the liquid to accelerate; essentially, the liquid does flow from the small base towards the large base of the truncated cone. The acceleration of the liquid along the conical surface is a function of the geometry of the conical surface, rotational speed, and flow properties of the liquid. Equally known are the industrial applications of the rotating cones as pumps, degassing devices, level controllers, such as described by Henderson, M. H., Hollow Cone Degassing, US Patent Application 2011/0219853 A1, Sep. 15, 2011.

Commercially available mixing devices operate on the physics of the rotating cones. For instance, in U.S. Pat. Nos. 3,170,638 and U.S. Pat. No. 3,170,639 by Burton, L., a Mixing and Disintegration Head is described. The patents describe a double-cone geometry, where both cones are hollow bodies; that is, the liquid is accelerated on both faces of the hollow cone, the outer face and the inner face. One embodiment discloses a distance piece (i.e. a cage) interposed between the large bases of the two cones, which features elongated openings extending the height of the piece. In another embodiment, there is a flat disc interposed between the large bases of the two cones; the periphery of the disc may be slotted or formed with a plurality of extended teeth; or even the teeth may be serrated in the nature of a rotary saw blade. And then there is another embodiment in which vanes pitched at an angle are installed inside the hollow cones to increases the pumping capacity of the device.

From the point of view of pumping capability, the rotating double-cone devices currently offered on the market have limitations in terms of the particulate size that can pass through the hollow cones; particulates entrained along the outer face of the cones are not limited by the size.

In U.S. Pat. No. 5,407,271 by Jø rgensen, P. J. et al., an Integrated Rotary Mixer and Disperser Head is described. It has a rotating mixing chamber of cylindrical geometry fitted with impeller blades that have ends located outside the mixing chamber to direct the liquid into the mixing chamber and out through some vertical elongated openings made in the wall of the mixing chamber. Similarly, in US Patent Application 2002/0118597 A1 by Korstvedt, H. O., a Mixing Head with axial flow is disclosed. It has a rotating mixing screen of cylindrical geometry that can be fitted with a variety of feeding elements installed at the ends of the screen; these feeding elements may be of different shapes, including flat and conical. The feeding elements include a plurality of openings formed at acute angles relative to the longitudinal axis such that, when rotated, the feeding elements induce liquid flow in an axial direction, inside the rotating screen. The mixing devices described by the Jø rgensen and Korstvedt patents feature entirely internal flow, incompatible with handling of particulates. In fact, these devices are tools mostly intended for comminution or micronization; instead of pumping alone.

Accordingly, there exists a need for a double-cone pumping device that is designed to provide for flow of the liquid product, and making them compatible with mixing of particulate-containing liquid products. Further, there is a need for a double-cone pumping device with large pumping action in mixing-agitation, instead of specific comminution-micronization action. It is therefore an object of the invention to provide a double-cone pumping device aimed at solving these problems, or to at least provide a useful alternative which addresses these needs.

SUMMARY

In a first aspect, the invention relates to double-cone pumping device, comprising two cones that are axially symmetrically arranged with their large bases abutting, and rotatable around the axis, and an axial shaft that connects to driving means. In a particular preferred design the double-cone pumping device comprises a flat disc and at least two rotating vanes and wherein the two cones are arranged so that their large bases lay on the opposite faces of the flat disc; and the vanes are located symmetrically onto the opposite sides of the flat disc; the flat disc and the vanes are rotatable with the two cones. It has been found that this design can generate a surprisingly large pumping action when rotating inside of a processing vessel.

In a second aspect, the invention relates to a use of the double-cone pumping device for processing liquid food.

The double-cone pumping device in this invention both allows pumping of fluids containing particulates of any size while ensuring a large pumping capacity. In a preferred embodiment, the double-cone pumping device is preferably made of two rotating cones that are substantially full bodies (as opposed to hollow). The rotating cones are preferably directly connected to a rotating disc that additionally displays rotating vanes on each one of its sides, in order to enhance the pumping capacity of the device.

In another embodiment, while substantially preserving the external flow feature of the double-cone pumping device, the combined physical body made of the two cones can be empty or can have an internal closed cavity, in order to reduce the total weight of the device. This does not change any of the external geometry of the double-cone pumping device, while the flow remains strictly external, and particulate-containing liquid products can be processed.

These and additional features and advantages are described herein, and will be apparent from the following Figures and Detailed Description of the device in this invention. The description of the invention in relation to the drawings is not intended to limit the invention.

DETAILED DESCRIPTION

Figure 1:
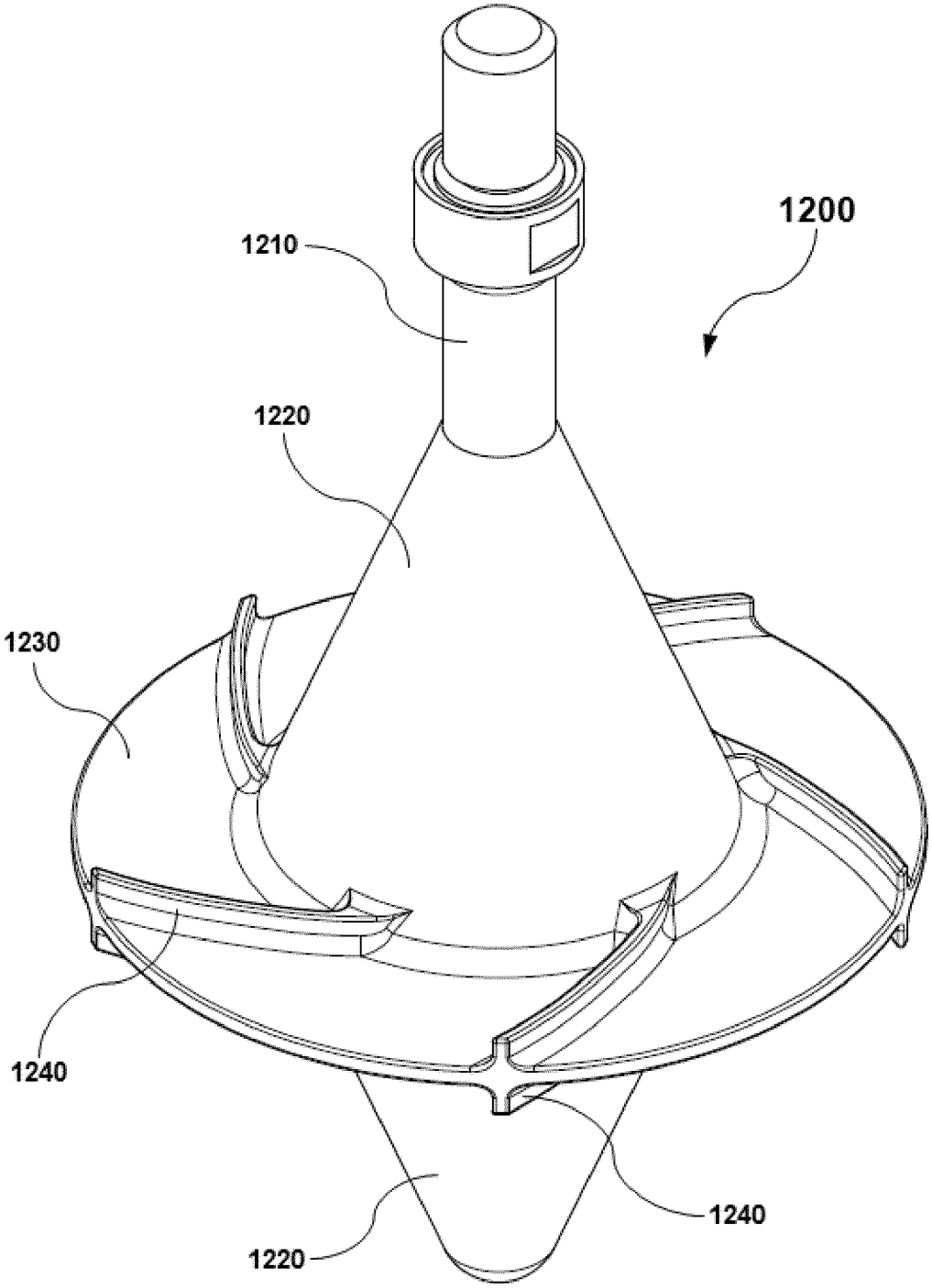
FIG. 1 illustrates a full view of a double-cone pumping device in accordance with an embodiment of the invention.

By comparison, the double-cone pumping device 1200 in FIG. 1 illustrates an embodiment of the invention both allows pumping of fluids containing particulates of any size and ensures a large pumping capacity. Pumping device 1200 is made of rotating cones 1220 that are full bodies (as opposed to hollow). Rotating cones 1220 are directly connected to a rotating disc 1230 that additionally displays rotating vanes 1240 on each one of its sides. Unlike rotating double-cone devices (featuring hollow cones) on the market, which are mainly intended for comminution or micronization, the pumping device 1200 is solely designed for an efficient pumping that generates a strong internal motion inside a processing vessel.

Referenced to the state-of-the-art, there are four major points of differentiation characterizing the pumping device in FIG. 1: First, rotating cones 1220 are full physical bodies. Second, rotating cones are directly connected to a rotating disc 1230. Third, rotating disc 1230 displays rotating vanes 1240 or blades on each side of the rotating disc. And fourth, as a result, the flow induced by the pumping device 1200 is entirely external to the rotating device, allowing for handling of particulates of any size. The two cones and the flat disc may be separate part or made out of one piece.

In another embodiment, while entirely preserving the external flow feature of the double-cone pumping device 1200, the combined physical body made of the two cones can be empty or can have an internal closed cavity, in order to reduce the total weight of the device. This does not change any of the external geometry of the double-cone pumping device, while the flow remains strictly on the outside of the device.

In yet another embodiment, the vanes on the rotating flat disc 1230 extend entirely along the rotating cones 1220, in a spiral configuration, to further increase the pumping capacity of the double-cone pumping device.

Figure 2:
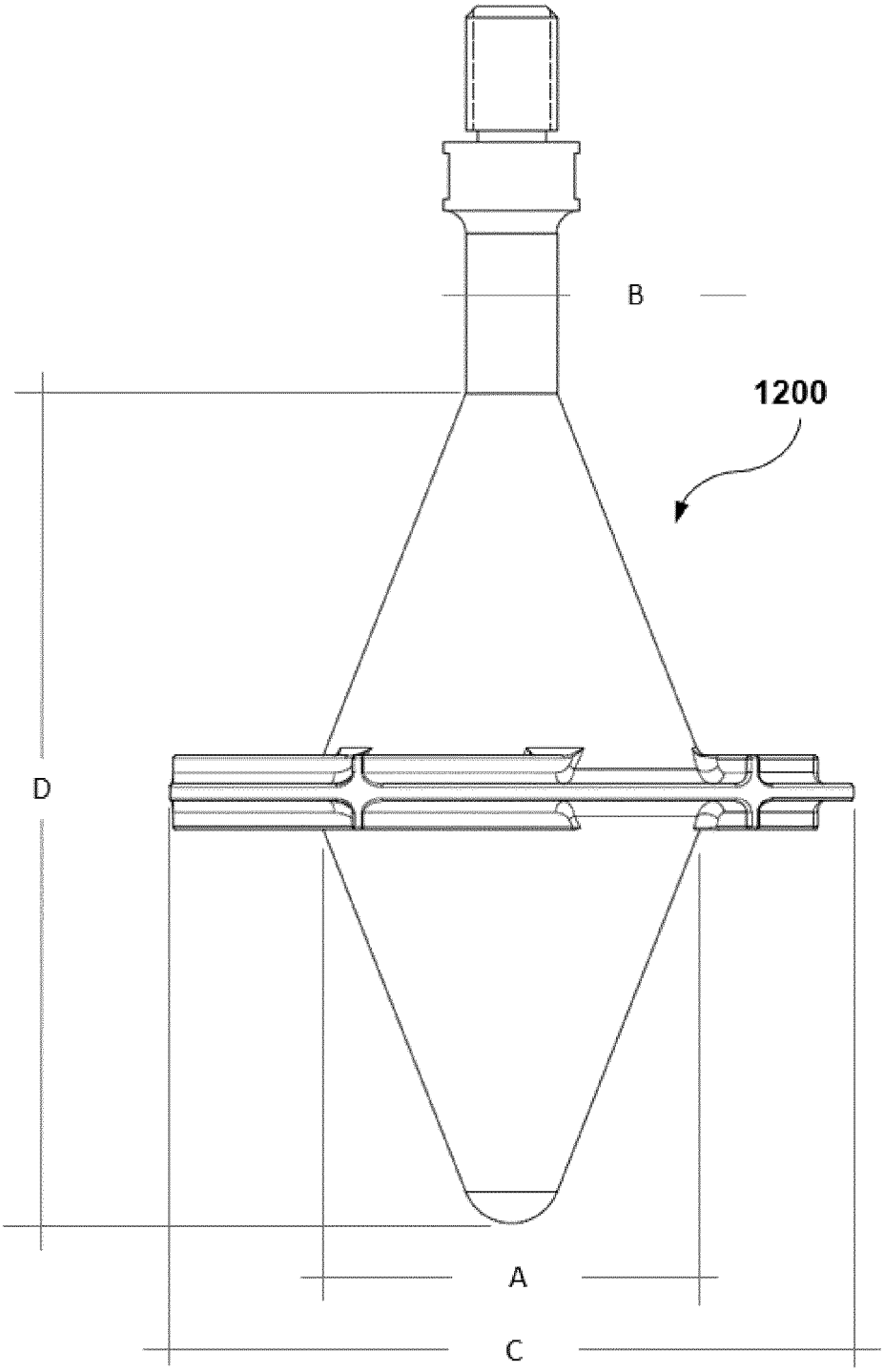
FIG. 2 illustrates a geometry of a double-cone pumping device in accordance with an embodiment of the invention.

FIG. 2 is an illustration to the geometry of the double-cone pumping device, whereby the range within which the dimensions can vary is limited only by the intended purpose of the pumping device, the design power of the device, the mechanical resistance of construction materials, etc. In the particular example of FIG. 2, the rotating cones have a large base diameter A and a small base diameter B; the rotating disc has a diameter C; and an overall height of the double-cone pumping device is D. It is preferred that A is in the range from 5 to 35 cm, B is from 1 to 15 cm, C is from 10 to 40 cm, and D is from 15 to 55 cm. In a particular preferred embodiment the A/B=5, A/C=0.5, and A/D=0.4.

The double-cone pumping device is installed within a processing vessel by means of a shaft, eventually associated with driving means such as a gear box and a motor drive to transfer the torque from the motor to the pumping device. Furthermore, the motor drive can have a variable frequency drive to allow rotational speeds in the range from 10 RPM to thousands RPM. The location of the pump shaft can be axially in the processing vessel, or sidewise, coming from the top end of the processing vessel, from the bottom end of the processing, or from any side of the processing vessel.

Any reference to prior art documents in this specification is not to be considered an admission that such prior art is widely known or forms part of the common general knowledge in the field.

Although the invention has been described by way of example, it should be appreciated that variations and modifications may be made without departing from the scope of the invention as defined in the claims. Furthermore, where known equivalents exist to specific features, such equivalents are incorporated as if specifically referred in this specification.

The invention claimed is:

1. A method for the processing of liquid food, the method comprising pumping the liquid food using a double-cone pumping device comprising two cones comprising a first cone and a second cone, each of the two cones having a large base, the two cones are axially symmetrically arranged with the large base of the first cone laying on a first face of a flat disc, and the large base of the second cone laying on a second face of the flat disc, the first cone and the second cone extending from the flat disc in opposite directions from each other, the pumping device comprising at least two rotating vanes comprising a first vane extending along the first face of the flat disc from a first end of the first vane connected to the large base of the first cone to a second end of the first vane positioned at a periphery of the flat disc, the at least two rotating vanes further comprise a second vane positioned symmetrically to the first vane along the first face of the flat disc on an opposite side of the first cone from the first vane, the at least two rotating vanes are rotatable together around the axis, and the double-cone pumping device comprises an axial shaft that connects to a driving member.

2. The method of claim 1, wherein the at least two rotating vanes further comprise a third vane and a fourth vane, the third vane and the fourth vane extending along the second face of the flat disc on opposite sides of the second cone relative to each other, and the first vane and the second vane are located symmetrically to the third vane and fourth vane.

3. The method of claim 1, wherein one or more of the at least two rotating vanes on the flat disc extend entirely along at least one of the two cones in a spiral configuration.

4. The method of claim 1, wherein the two cones form a physical body that is empty or has an internal closed cavity.

5. The method of claim 1, wherein the two cones form a physical body that is not hollow.

6. The method of claim 1, wherein the two cones are made out of one piece of material.

7. The method of claim 1, wherein a circumference of the flat disc is greater than a circumference of the large base of the first cone.

8. The method of claim 7, wherein a ratio of the circumference of the large base of the first cone to the circumference of the flat disc is between 0.5 and 0.875.

* * * * *